US008474932B2

(12) United States Patent
Kawabata

(10) Patent No.: US 8,474,932 B2
(45) Date of Patent: Jul. 2, 2013

(54) IMAGE FORMING APPARATUS

(75) Inventor: Yoichi Kawabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 45 days.

(21) Appl. No.: 13/296,562

(22) Filed: Nov. 15, 2011

(65) Prior Publication Data

US 2012/0139992 A1 Jun. 7, 2012

(30) Foreign Application Priority Data

Dec. 2, 2010 (JP) ..... 2010-269777

(51) Int. Cl.
*B41J 2/195* (2006.01)
*B41J 29/393* (2006.01)

(52) U.S. Cl.
USPC ..... 347/7; 347/19

(58) Field of Classification Search
CPC ..... B41J 2/17509; B41J 2/17566
USPC ..... 347/7, 19, 86, 87
See application file for complete search history.

(56) References Cited

U.S. PATENT DOCUMENTS

| | | | | |
|---|---|---|---|---|
| 6,796,627 | B2 * | 9/2004 | Kimura et al. | 347/7 |
| 7,798,586 | B2 * | 9/2010 | Watanabe | 347/7 |
| 8,348,364 | B2 * | 1/2013 | Taga | 347/7 |
| 2009/0289992 | A1 | 11/2009 | Kawabata | |

FOREIGN PATENT DOCUMENTS

| | | |
|---|---|---|
| JP | 2010-143158 | 7/2010 |

* cited by examiner

*Primary Examiner* — An Do
(74) *Attorney, Agent, or Firm* — Cooper & Dunham LLP

(57) ABSTRACT

An image forming apparatus includes a head tank and a main tank that sends liquid to the head tank. When the remaining ink amount in the main tank is less than or equal to a predetermined amount (near empty), the liquid sending amount to be sent from the main tank to the head tank required for detecting a full state of the head tank is set to be a second liquid sending amount which is greater than a usual first liquid sending amount. An ink supply operation is performed to send liquid corresponding to the second liquid sending amount, from the main tank to the head tank. Then, it is determined whether the head tank is in a full state. When the head tank is not in a full state, the main tank is determined to be in an ink empty state.

3 Claims, 13 Drawing Sheets

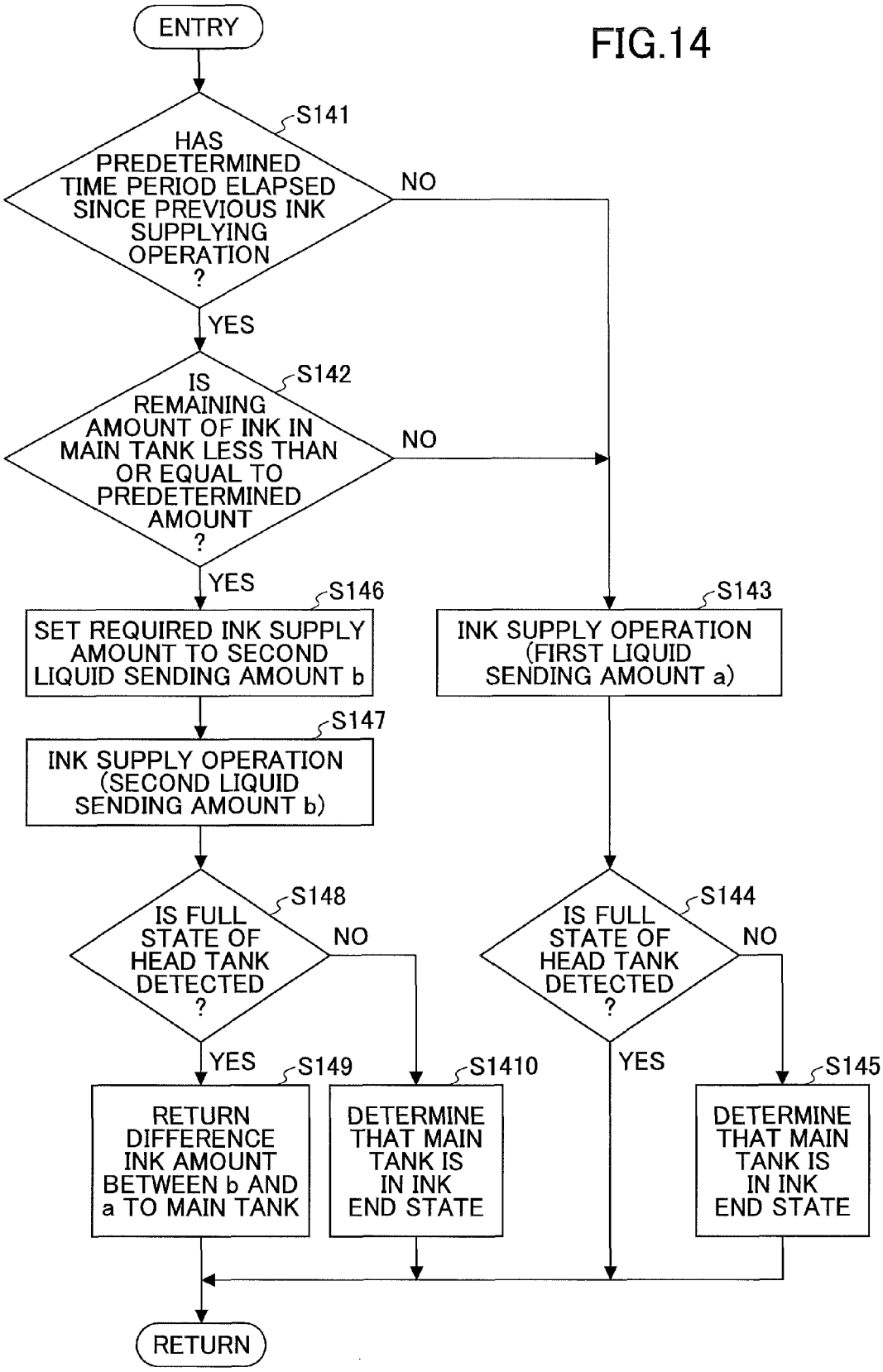
FIG.14
ENTRY
S141
HAS PREDETERMINED TIME PERIOD ELAPSED SINCE PREVIOUS INK SUPPLYING OPERATION ?
NO
YES
S142
IS REMAINING AMOUNT OF INK IN MAIN TANK LESS THAN OR EQUAL TO PREDETERMINED AMOUNT ?
NO
YES
S146
SET REQUIRED INK SUPPLY AMOUNT TO SECOND LIQUID SENDING AMOUNT b
S143
INK SUPPLY OPERATION (FIRST LIQUID SENDING AMOUNT a)
S147
INK SUPPLY OPERATION (SECOND LIQUID SENDING AMOUNT b)
S148
IS FULL STATE OF HEAD TANK DETECTED ?
NO
YES
S144
IS FULL STATE OF HEAD TANK DETECTED ?
NO
YES
S149
RETURN DIFFERENCE INK AMOUNT BETWEEN b AND a TO MAIN TANK
S1410
DETERMINE THAT MAIN TANK IS IN INK END STATE
S145
DETERMINE THAT MAIN TANK IS IN INK END STATE
RETURN

IMAGE FORMING APPARATUS

BACKGROUND OF THE INVENTION

1. Field of the Invention

The present invention relates to an image forming apparatus, and more particularly to an image forming apparatus including a recording head for jetting liquid droplets.

2. Description of the Related Art

There are image forming apparatuses such as printers, fax machines, copiers, plotters, and multifunction peripherals including functions of these devices. An inkjet recording apparatus is known as an example of an image forming apparatus of a liquid jet recording method using recording heads constituted by liquid jetting heads (liquid droplet jetting heads) for jetting ink droplets. Such an image forming apparatus of a liquid jet recording method forms images (record and print may be used synonymously as form) by jetting ink droplets from recording heads onto a conveyed sheet (the sheet is not limited to a paper sheet; the sheet may be any sheet onto which ink droplets or other types of liquid can adhere such as an OHP transparency film; the sheet may also be referred to as a recording medium, a recording sheet, etc.). There are several types of image forming apparatuses that perform a liquid jet recording method. One example is a serial type image forming apparatus that forms images by jetting liquid droplets while moving the recording heads in a main scanning direction. Another example is a line type image forming apparatus that uses line type heads to form images by jetting liquid droplets while the recording heads do not move.

In the present application, an image forming apparatus that performs a liquid jet recording method means an apparatus that forms images by jetting liquid onto a medium such as paper, thread, fiber, cloth, leather, metal, plastic, glass, wood, ceramics, etc. Forming images on a medium means forming images having meaning (such as characters and figures) and forming images without any meaning (such as patterns, e.g., merely jetting liquid droplets onto a medium). Ink is not limited to what is generally referred to as ink; ink refers to any kind of liquid that can be used for forming images, such as recording liquid and fixing process liquid; examples of ink are DNA samples, resist, and pattern material. Furthermore, an image is not limited to a planar image, an image may be formed on a three-dimensional object, or a three-dimensional object may be formed.

There is known an image forming apparatus provided with a head tank for supplying ink to recording heads (also referred to as a sub tank and a buffer tank). In this type of image forming apparatus, ink is supplied from a main tank (also referred to as an ink cartridge), which is detachably attached to the main unit of the apparatus, to the head tank, with the use of a liquid sending pump constituted by a tube pump.

Patent Document 1: Japanese Laid-Open Patent Publication No. 2010-143158

In a case where the above-described tube pump (tubing pump) is used for sending liquid, and ink is supplied from the main tank to the head tank, when the amount of ink remaining inside the main tank becomes small, the negative pressure inside the tube pump connected to the main tank increases. Thus, a difference arises between the pressure inside the tube pump and the atmospheric pressure outside the pump. Accordingly, air enters inside the tube through a flexible tube. When air enters the tube unexpectedly, the following problem arises when air is sent to the head tank.

Specifically, if the tube is filled with ink, and the main tank becomes empty (end state) and no more ink can be sent to the head tank, the end state of the main tank can be detected by detecting that ink is not being supplied at the head tank. Thus, a message prompting to replace the main tank is displayed and the operation can be stopped.

However, when the remaining amount of ink in the main tank becomes small (near end state), and air enters the tube before the ink end state, the air is sent into the head tank together with the ink. When a full state is detected at the head tank by detecting the displacement of a flexible member, the air mixed in the ink cannot be detected. Thus, even if the head tank is not sufficiently filled with ink, it will be erroneously detected that the operation of supplying (filling) the head tank with ink has been completed.

Consequently, even if there is no more ink remaining in the main tank, the ink end state cannot be detected, and therefore the operation of detecting the ink end state of the main tank is delayed. Thus, even more air enters the tube. Furthermore, foam is generated in the supply path as air and ink are mixed together. If this foam enters the head tank, and the head tank has a flow path connected to the atmosphere, the ink with foam enters the flow path connected to the atmosphere. Thus, when an atmosphere opening valve is opened, air is obstructed from properly exiting from/entering into the head tank.

SUMMARY OF THE INVENTION

The present invention provides an image forming apparatus in which one or more of the above-described disadvantages are eliminated.

A preferred embodiment of the present invention provides an image forming apparatus in which the end state of a main tank is detected at the head tank as soon as the main tank is out of liquid.

According to an aspect of the present invention, there is provided an image forming apparatus including a recording head configured to jet liquid droplets; a head tank configured to accommodate liquid to be supplied to the recording head; a main tank configured to accommodate liquid to be supplied to the head tank; a liquid sending pump configured to send the liquid from the main tank to the head tank; a full tank detection unit configured to detect whether the head tank is in a full state when sending liquid from the main tank to the head tank; an empty determination unit configured to determine an empty state of the main tank, when the full state of the head tank is not detected by the full tank detection unit even if a predetermined liquid sending amount is sent from the main tank to the head tank; and a near empty detection unit configured to detect whether a remaining liquid amount in the main tank is less than or equal to a predetermined remaining amount, wherein the full tank detection unit switches the predetermined liquid sending amount to be sent from the main tank to the head tank, which is required for detecting whether the head tank is in the full state, between a first liquid sending amount and a second liquid sending amount that is greater than the first liquid sending amount, wherein the full tank detection unit detects whether the head tank is in the full state based on a liquid sending operation of sending the first liquid sending amount, when the remaining liquid amount in the main tank is greater than the predetermined remaining amount, and the full tank detection unit detects whether the head tank is in the full state based on a liquid sending operation of sending the second liquid sending amount, when the remaining liquid amount in the main tank is less than or equal to the predetermined remaining amount.

BRIEF DESCRIPTION OF THE DRAWINGS

Other objects, features and advantages of the present invention will become more apparent from the following detailed description when read in conjunction with the accompanying drawings, in which:

FIG. 14 is a flowchart for describing a control operation of sending ink from the main tank to the head tank according to a third embodiment of the present invention.

DETAILED DESCRIPTION OF THE PREFERRED EMBODIMENTS

A description is given, with reference to the accompanying drawings, of embodiments of the present invention.

Figure 1:
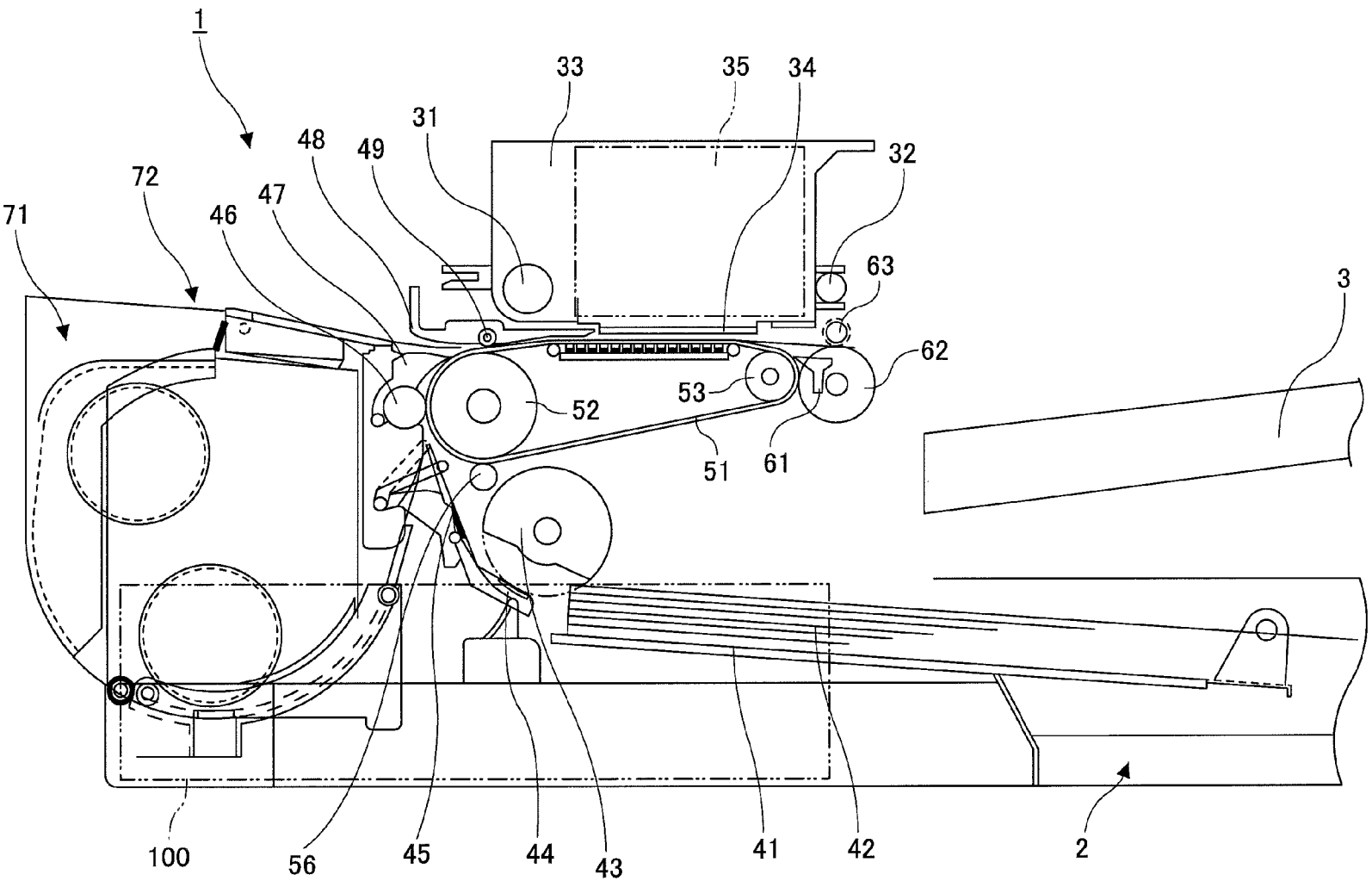
FIG. 1 is a side view for describing the overall configuration of an image forming apparatus according to an embodiment of the present invention.
Figure 2:
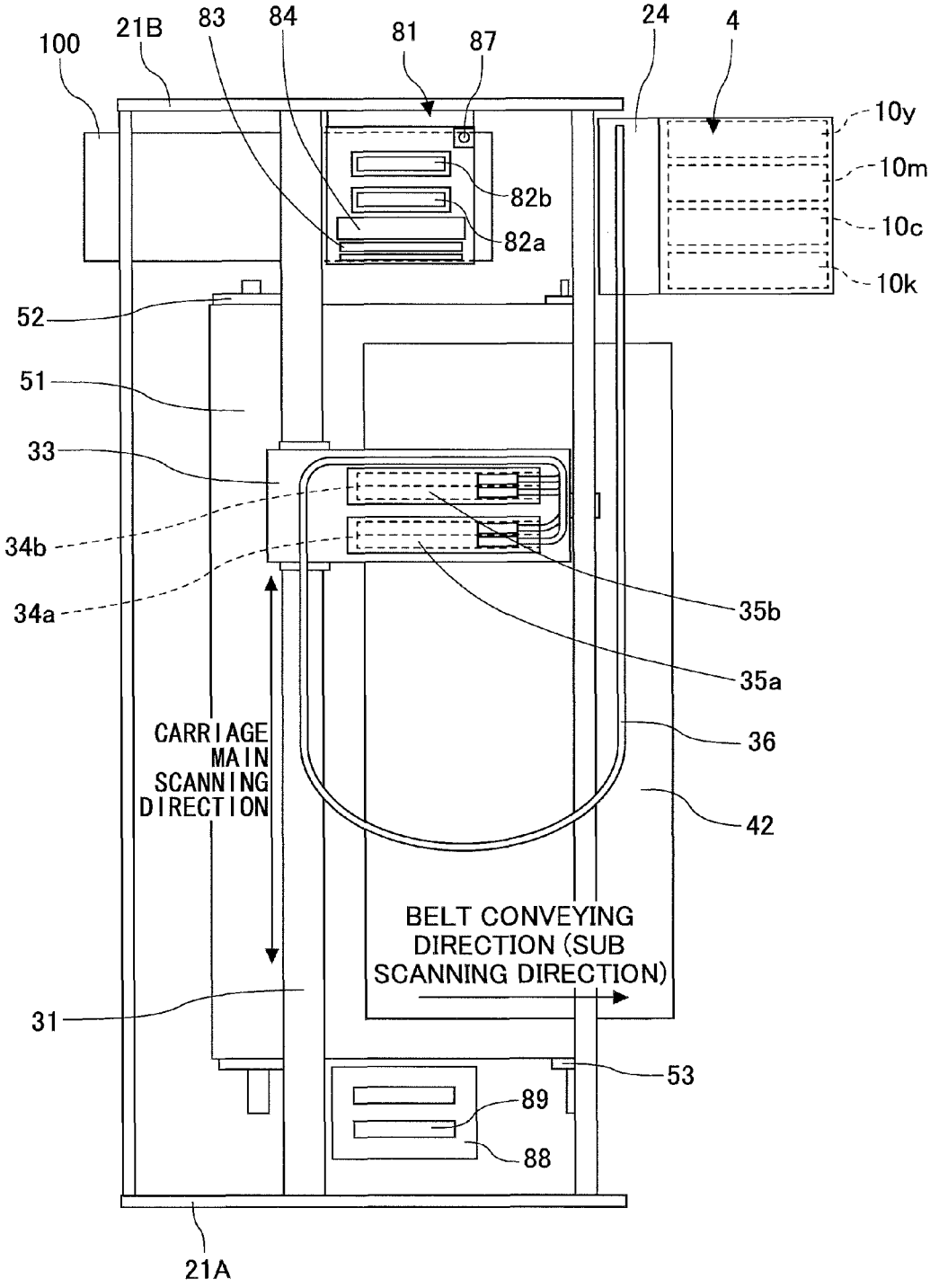
FIG. 2 is a plan view of relevant parts of the image forming apparatus.

First, an image forming apparatus according to an embodiment of the present invention is described with reference to FIGS. 1 and 2. FIG. 1 is a side view for describing the overall configuration of the image forming apparatus, and FIG. 2 is a plan view of relevant parts of the image forming apparatus.

This image forming apparatus is a serial-type inkjet recording device. The serial-type inkjet recording device includes side plates 21A and 21B provided on the left and right sides of a device main unit 1, primary and secondary guide rods 31 and 32 that are guide members bridged between the side plates 21A and 21B, and a carriage 33 that is held by the guide rods 31 and 32 and that is dividable in the main scanning direction. The carriage 33 is moved in the main scanning direction by a main scanning motor described below via a timing belt.

The carriage 33 includes recording heads 34*a* and 34*b* (referred to as "recording heads 34" when not distinguished from one another) including liquid jetting heads for jetting ink droplets of the respective colors of yellow (Y), cyan (C), magenta (M), and black (K). The recording heads 34*a* and 34*b* include nozzle rows including plural nozzles, which are aligned in the sub scanning direction orthogonal to the main scanning direction, with the ink droplet jetting direction facing downward.

Each recording head 34 includes two nozzle rows. In the recording head 34*a*, one nozzle row jets black (K) liquid droplets and the other nozzle row jets cyan (C) liquid droplets. In the recording head 34*b*, one nozzle row jets magenta (M) liquid droplets and the other nozzle row jets yellow (Y) liquid droplets.

Furthermore, the carriage 33 includes head tanks 35*a* and 35*b* (referred to as "head tanks 35" when not distinguished from one another) corresponding to the nozzle rows of the recording heads, for supplying ink of the respective colors. Ink of the respective colors are supplied to the head tanks 35 by a supplying pump unit 24 from ink cartridges 10*y*, 10*m*, 10*c*, and 10*k*, which are main tanks of the respective colors, via supplying tubes 36 of the respective colors.

Meanwhile, a sheet feeding unit is provided for feeding sheets 42 stacked on a sheet stacking unit (platen) 41 of a sheet feeding tray 2. The sheet feeding unit includes a half-moon roller (sheet feeding roller) 43 for separating the sheets 42 one by one from the sheet stacking unit 41 and sending the sheets out, and a separating pad 44 facing the half-moon roller 43. The separating pad 44 is made of a material having a high friction coefficient. The separating pad 44 is biased toward the half-moon roller 43.

For the purpose of sending the sheet 42 fed from the sheet feeding unit to a position below the recording heads 34, a guide member 45 for guiding the sheet 42, a counter roller 46, a conveying guide member 47, and a pushing member 48 including a leading edge pressurizing roller 49 are provided. There is also provided a conveying belt 51 acting as a conveying unit, for conveying the fed sheet 42 to a position facing the recording heads 34 by attracting the sheet 42 with static electricity.

The conveying belt 51 is an endless belt, which is round around a conveying roller 52 and a tension roller 53, and which moves around in the belt conveying direction (sub scanning direction). Furthermore, there is provided a charging roller 56 acting as a charging unit for charging the surface of the conveying belt 51. The charging roller 56 contacts the surface of the conveying belt 51, and is arranged so to be rotated as the conveying belt 51 moves around. The conveying belt 51 moves around in the belt conveying direction as the conveying roller 52 is rotated by a sub scanning motor with timing.

Furthermore, a sheet discharge unit is provided for discharging the sheet 42 on which recording has been performed with the recording heads 34. The sheet discharge unit includes a separation claw 61 for separating the sheet 42 from the conveying belt 51, a sheet discharge roller 62, a spur 63 that is a sheet discharge roller, and a sheet discharge tray 3 provided below the sheet discharge roller 62.

Furthermore, a double-sided unit 71 is detachably attached to the back side of the device main unit 1. The double-sided unit 71 takes in the sheet 42 that is returned as the conveying belt 51 moves around in the reverse direction, inverts the sheet 42, and once again feeds the sheet 42 in between the counter roller 46 and the conveying belt 51. The top surface of the double-sided unit 71 acts as a manual feed tray 72.

Furthermore, in a non-printing area on one side of the scanning direction of the carriage 33, there is provided a maintenance recovery mechanism 81 for maintaining and recovering the states of the nozzles of the recording heads 34. The maintenance recovery mechanism 81 includes cap members (referred to as "caps 82" when not distinguished from one another) 82*a* and 82*b* for capping the nozzle surfaces in the recording heads 34, a wiper member (wiper blade) 83 for wiping the nozzle surfaces, an idle jetting receiver 84 for receiving liquid droplets that are jetted when idle jetting is performed, and a carriage lock 87 for locking the carriage 33. Idle jetting is performed by jetting liquid droplets that do not contribute to printing, for the purpose of discharging the recording liquid that has increased in viscosity. Furthermore, a waste liquid tank 100 for accommodating waste liquid that is generated as a result of the maintenance recovery operation is provided below the maintenance recovery mechanism 81 for the heads. The waste liquid tank 100 is exchangeably attached to the device main unit 1.

Furthermore, in the non-printing area on the other side of the scanning direction of the carriage 33, there is provided an idle jetting receiver 88 for receiving liquid droplets that are jetted when idle jetting is performed. Idle jetting is performed by jetting liquid droplets that do not contribute to printing for the purpose of discharging the recording liquid that has increased in viscosity, during a recording operation. The idle jetting receiver 88 includes openings 89 extending along a nozzle row direction of the recording heads 34.

In an image forming apparatus having the above configuration, the sheets 42 are separated from the sheet feeding tray 2 one by one. The sheet 42 that has been fed in a substantially perpendicular upward direction is guided by the guide member 45, and conveyed while being sandwiched between the conveying belt 51 and the counter roller 46. Furthermore, the leading edge of the sheet 42 is guided by the conveying guide member 47 and pressed against the conveying belt 51 by the leading edge pressurizing roller 49. Thus, the conveying direction of the sheet 42 is turned by substantially 90 degrees.

At this time, voltage is applied to the charging roller 56 so that a positive output and a negative output are alternately repeated (alternating voltage), and alternating charge voltage patterns are formed on the conveying belt 51, i.e., the conveying belt 51 is alternately charged by positive and negative strips of a predetermined width, in a sub scanning direction which is the direction in which the conveying belt 51 moves around. When the sheet 42 is sent onto the conveying belt 51 that is alternately charged by positive and negative strips, the sheet 42 is attracted to the conveying belt 51, and the sheet 42 is conveyed in the sub scanning direction as the conveying belt 51 moves around.

By driving the recording heads 34 in accordance with image signals while moving the carriage 33, ink droplets are jetted onto the static sheet 42 to record one line. Then, the sheet 42 is conveyed by a predetermined amount, and the next line is recorded. Upon receiving a record end signal or a signal indicating that the trailing edge of the sheet 42 has reached the recording area, the recording operation is ended, and the sheet 42 is discharged to the sheet discharge tray 3.

When a maintenance recover operation is performed on the nozzles of the recording heads 34, the carriage 33 is moved to the position facing the maintenance recovery mechanism 81 which is the home position. Then, the maintenance recovery operation is performed, involving capping the nozzles with the cap members 82 to suction ink from the nozzles and performing idle jetting by jetting liquid droplets that do not contribute to image formation. Accordingly, with the nozzles that have undergone the maintenance recovery operation, images can be formed by stably jetting liquid droplets.

Figure 3:
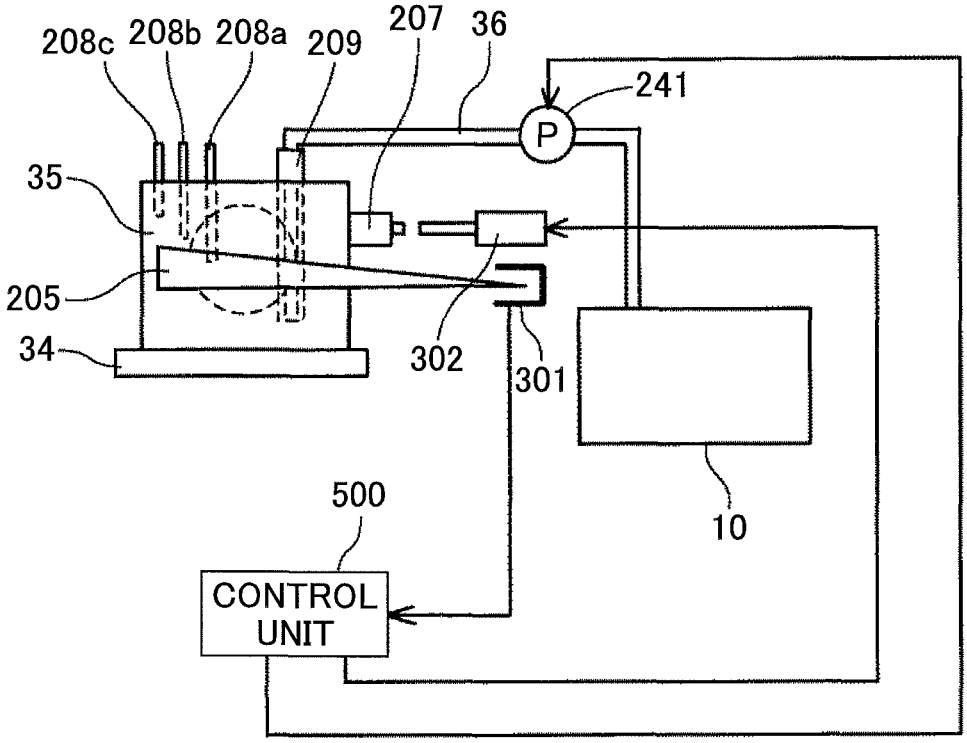
FIG. 3 is a schematic diagram for describing an ink supply system.

Next, a description is given of an ink supply system in the image forming apparatus according to the present embodiment with reference to the schematic diagram of FIG. 3.

The ink supply system includes a head tank 35 for supplying ink to the recording head 34, an ink cartridge (main tank) 10 for accommodating the ink to be supplied to the head tank 35, and a liquid sending pump 241 provided between the ink cartridge (main tank) 10 and the head tank 35. The liquid sending pump 241 includes a reversible pump (reversible meaning capable of both supplying and suctioning) such as a tube pump. A pump driving motor 242 (see FIG. 8) for driving the liquid sending pump 241 is controlled to send ink from the ink cartridge (main tank) 10 to the head tank 35 (normal liquid sending), and to send ink from the head tank 35 to the ink cartridge (main tank) 10 (reversed liquid sending).

In this device, when the recording head 34 jets liquid droplets to form an image, the amount of ink to be jetted (calculated by the ink consumption amount=number of droplets× appropriate amount) is stored as a soft count value. When the ink consumption amount reaches a predetermined threshold, the ink is supplied from the ink cartridge (main tank) 10 to the head tank 35, and the head tank 35 is filled up. The operation of detecting a filled up state is described below.

Furthermore, when supplying ink from the ink cartridge (main tank) 10 to the head tank 35, when a filled up state cannot be detected at the head tank 35 even if an operation of supplying a predetermined amount of ink has been performed (by driving the liquid sending pump 241), it can be detected (determined) that the ink cartridge (main tank) 10 is in an ink end state.

In the present embodiment, negative pressure is formed in the head tank 35 by sending ink from the head tank 35 to the ink cartridge (main tank) 10, so that the ink used for forming negative pressure can be reused, thereby reducing the amount of wasteful ink consumption.

Figure 4:
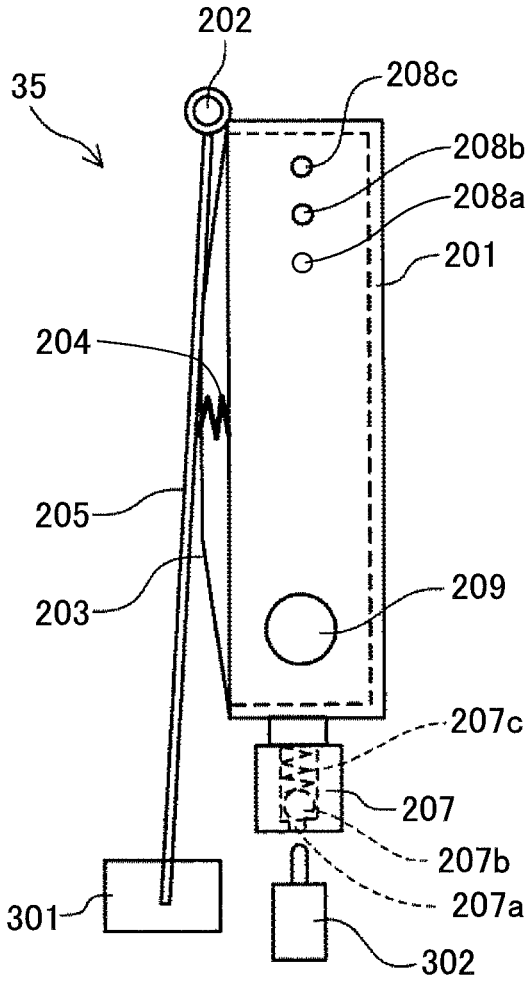
FIG. 4 is a schematic plan view of a head tank.
Figure 5:
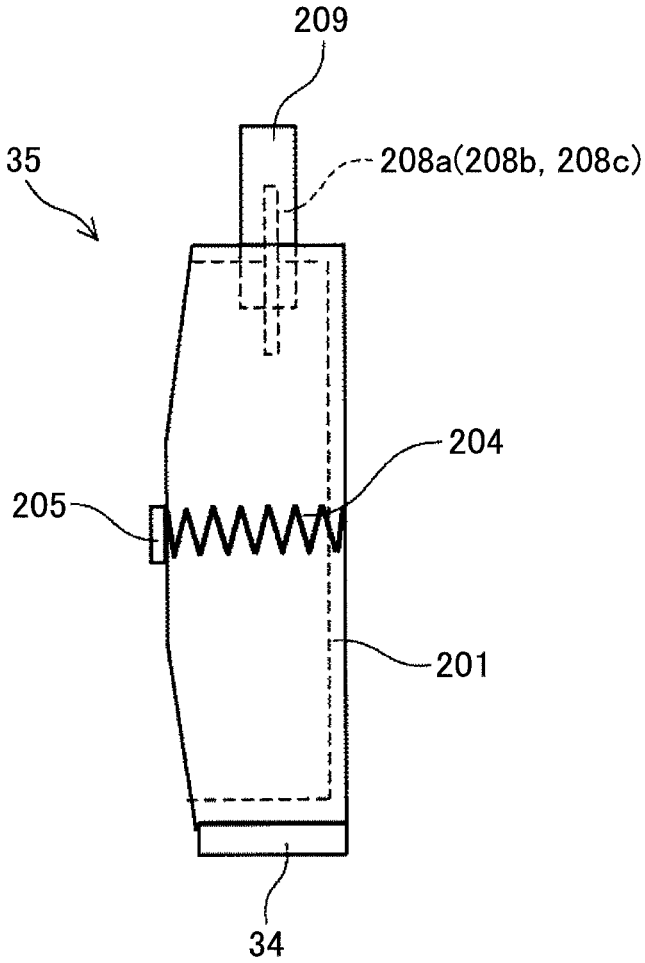
FIG. 5 is a schematic front view of the head tank shown in FIG. 4.

Next, a description is given of an example of the head tank 35 with reference to FIGS. 4 and 5.

FIG. 4 is a schematic plan view of one of the head parts of the head tank 35, and FIG. 5 is a schematic front view of one of the head parts of the head tank 35.

The head tank 35 has a tank case 201 forming an ink accommodating part having one side open, for holding ink. The opening of the tank case 201 is sealed by a flexible film 203. The film 203 is constantly biased toward the outside by a spring 204 acting as an elastic member positioned inside the tank case 201. As the film 203 of the tank case 201 is biased toward the outside by the spring 204, negative pressure is generated as the remaining amount of ink inside the tank case 201 decreases.

Furthermore, outside the tank case 201, a displacement member (also referred to as a full tank detection filler) 205 is fixed to the film 203 with an adhesive. The displacement member 205 has one end swingably supported by a spindle 202. The displacement member 205 is made of a film that is biased toward the tank case 201. The displacement member 205 is displaced in coordination with the movement of the film 203. Therefore, by detecting the displacement amount of the displacement member 205 with a full tank detection sensor 301 constituted by an optical sensor disposed at the device main unit 1, the remaining amount of ink inside the head tank 35 can be detected.

Furthermore, at the upper part of the tank case 201, there is provided a supply opening 209 through which ink is supplied from the ink cartridge (main tank) 10, which is connected to an ink supply tube 36. Furthermore, on the side of the tank case 201, an atmosphere opening mechanism 207 for opening the inside of the head tank 35 to the atmosphere is provided. The atmosphere opening mechanism 207 includes a valve **207*b* for opening and closing an atmosphere opening path 207*a* connecting to the inside of the head tank 35, and a spring 207*c* that biases the valve 207*b* to a closed state. By pushing the valve 207*b* with an atmosphere opening solenoid 302 provided on the device main unit 1, the valve 207*b* is opened, so that the inside of the head tank 35 is in an atmosphere open state (a state in which the inside of the head tank 35** is connected to the atmosphere).

Furthermore, plural electrode pin members (hereinafter, "electrode pins") 208*a*, 208*b*, and 208*c* having different lengths are attached for detecting the height of the ink surface inside the head tank 35. The ink is electrically conductive, and when the ink reaches any of the electrode pins 208*a*, 208*b*, and 208*c*, a current flows between the electrode pins 208*a* and 208*b* and between the electrode pins 208*a* and 208*c* and the resistances of the currents change. Accordingly, it can be detected that the height of the ink surface has become a predetermined height.

Figure 6:
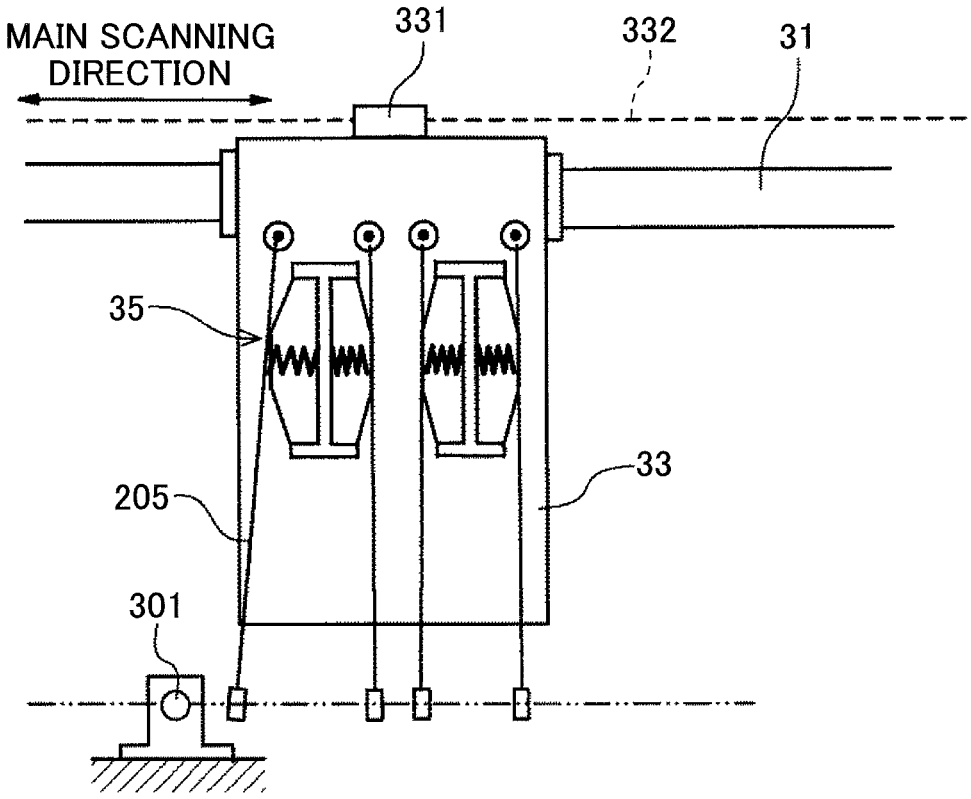
FIG. 6 is a diagram of relevant parts of a carriage and a full state detecting sensor for describing a full tank detection operation of the head tank.
Figure 7A:
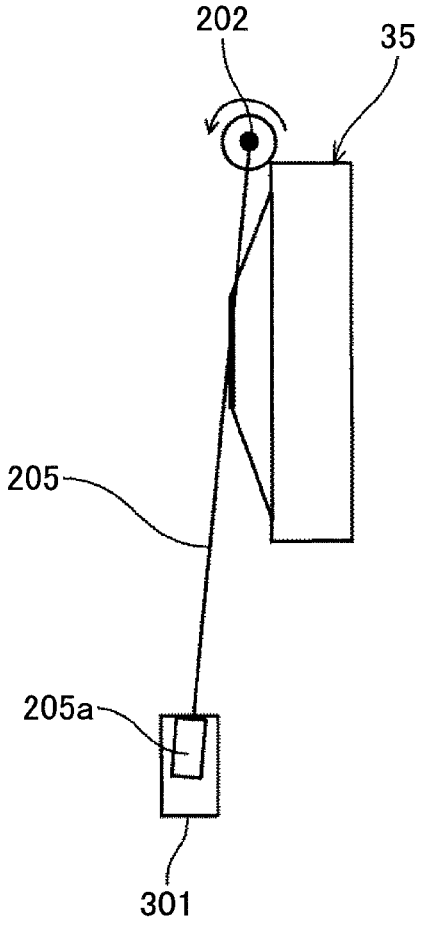
FIGS. 7A and 7B are schematic diagrams for describing the full tank detection operation of the head tank.
Figure 7B:
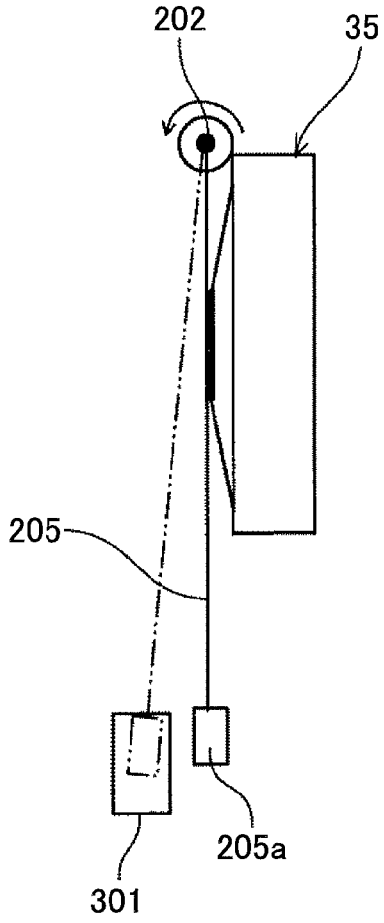

Next, a description is given of a full tank detection operation of the head tank 35, with reference to FIGS. 6, 7A, and 7B.

As shown in FIG. 6, on the device main unit 1, the full tank detection sensor 301 that is a transmissive optical sensor is disposed at a position where a leading edge 205*a* of the displacement member (full tank detection filler) 205 of each head tank 35 passes when the carriage 33 moves in the main scanning direction. The position of the carriage 33 in the main scanning direction is detected by reading encoder scales 332 positioned along the main scanning direction of the carriage 33, with the use of an encoder sensor 331.

Thus, as shown in FIG. 7A, when the head tank 35 is filled up, the position of the carriage 33 when the full tank detection sensor 301 detects the leading edge 205*a* of the displacement member 205 is stored. As shown in FIG. 7B, the carriage 33 is moved to the stored position, and ink is filled into the head tank 35 by normal liquid sending, in an atmosphere open state. Accordingly, the displacement member (full tank detection filler) 205 is displaced from the position indicated by a solid line to the position indicated by a dashed line. Thus, at the moment when the full tank detection sensor 301 detects the leading edge 205*a* of the displacement member (full tank detection filler) 205, it is detected that the head tank 35 has become full.

In this case, the amount of ink to be sent to the head tank 35 for detecting that the head tank 35 is full, can be changed by changing the position of the carriage 33. That is to say, when the ink is sent from the ink cartridge (main tank) 10 to the head tank 35, the more the position of the displacement member (full tank detection filler) 205 of the carriage 33 is moved away from the full tank detection sensor 301, the amount of ink to be sent for detecting that the head tank 35 is full becomes greater.

For example, a first set liquid sending amount and a second set liquid sending amount that is greater than the first set liquid sending amount may be set as amounts of ink to be sent for detecting that the head tank 35 is full. Under normal circumstances, the head tank 35 is detected as being full by sending the first set liquid sending amount. When the remaining amount of ink in the ink cartridge (main tank) 10 becomes less than or equal to a predetermined amount (referred to a "near end" state), the head tank 35 is not detected as being full unless the second set liquid sending amount is sent. Accordingly, when the ink cartridge (main tank) 10 is in a near end state, the head tank 35 is not detected as full with the first set liquid sending amount; the head tank 35 can be detected as full only with the second set liquid sending amount. Thus, it can be determined that the ink cartridge (main tank) 10 is in an end state.

The above-described processes (operations) such as soft count, detecting the near end state of the ink cartridge (main tank) 10, detecting the full state of the head tank 35, and determining (detecting) the end state of the ink cartridge (main tank) 10 are performed by a control unit 500 (see FIG. 3) of the image forming apparatus.

Figure 8:
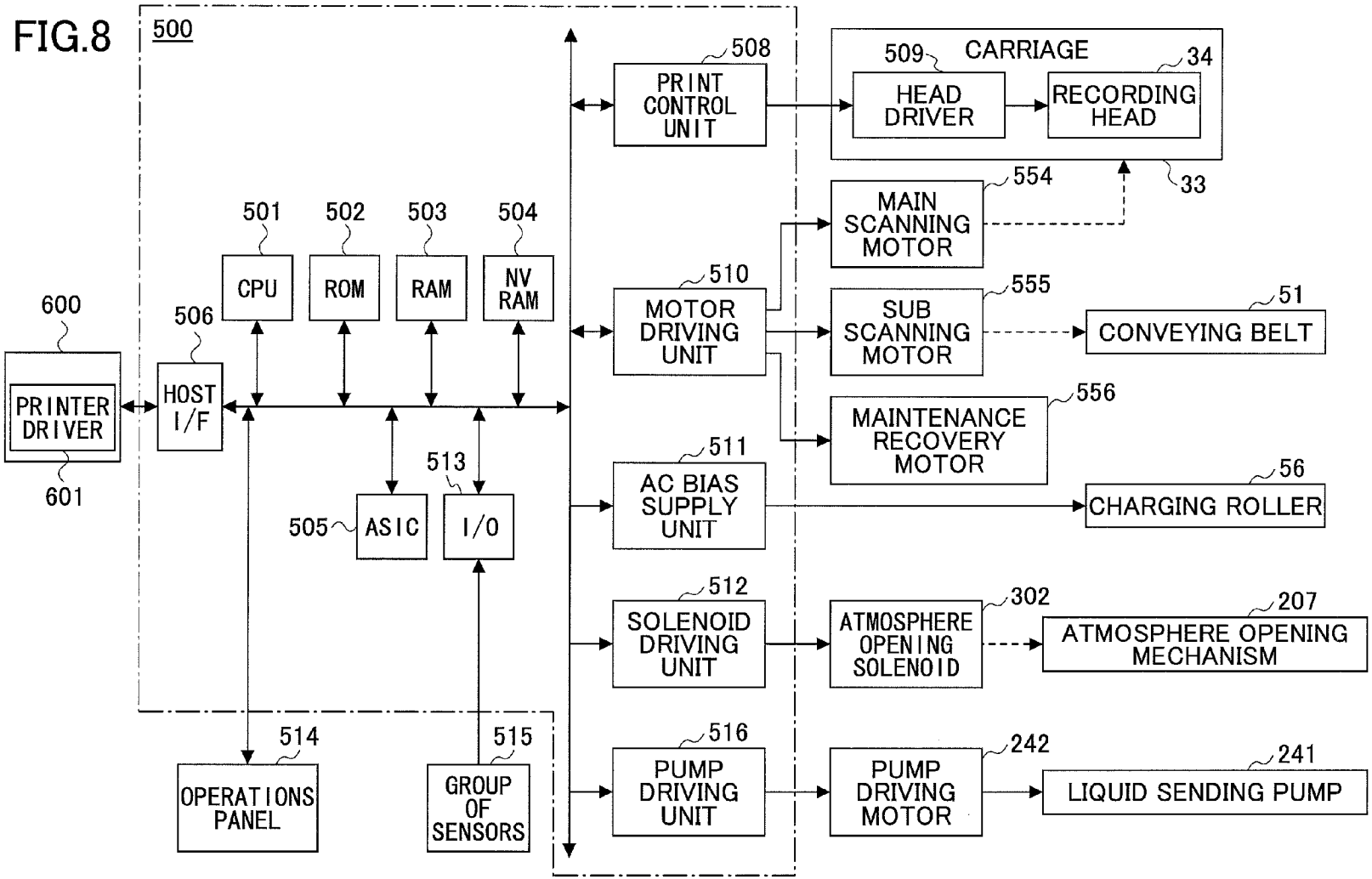
FIG. 8 is an overall block diagram of a control unit of the image forming apparatus.

Next, a summary of the control unit 500 of the image forming apparatus is described with reference to FIG. 8. FIG. 8 is an overall block diagram of the control unit 500.

The control unit 500 includes a CPU 501 for controlling the entire device; a ROM 502 for performing various detection operations according to an embodiment of the present invention executed by the CPU 501 and for storing programs including control programs and other fixed data; a RAM 503 for temporarily storing image data; a rewritable non-volatile memory 504 for holding data even while the power of the device is shut off; and an ASIC 505 for performing various signal processes on the image data, image processing such as rearranging, and processing of input/output signals for controlling the entire device.

Furthermore, the control unit 500 includes a print control unit 508 including a data transfer means and a drive signal generating means for driving/controlling the recording head 34; a head driver (driver IC) 509 for driving the recording head 34 provided on the carriage 33; a motor driving unit 510 for driving a main scanning motor 554 that moves the carriage 33, a sub scanning motor 555 that moves around the conveying belt 51, and a maintenance recovery motor 556 of the maintenance recovery mechanism 81; an AC bias supply unit 511 for supplying an AC bias to the charging roller 56; a solenoid driving unit 512 for driving the atmosphere opening solenoid 302 that opens/closes the atmosphere opening mechanism 207 of the head tank 35; and a pump driving unit 516 for driving the liquid sending pump 241.

The control unit 500 has an operations panel 514 used for inputting and displaying information required for this device.

The control unit 500 includes a host I/F 506 for exchanging data and signals with a host 600. Specifically, the control unit 500 receives data and signals with the host I/F 506 via a cable or a network, from the host 600 such as an information processing apparatus such as a personal computer, an image scanning apparatus such as an image scanner, and an image pickup device such as a digital camera.

The CPU 501 of the control unit 500 reads and analyzes the print data in a reception buffer included in the host I/F 506, performs required image processing and data rearranging processes at the ASIC 505, and transfers the image data from the print control unit 508 to the head driver 509. The dot pattern data for outputting an image is generated by a printer driver 601 at the host 600.

The print control unit 508 transfers the above image data as serial data, and outputs, to the head driver 509, transfer clocks, latch signals, and control signals required for transferring the image data and validating the transfer. In addition, the print control unit 508 includes a driving signal generating unit constituted by a D/A converter for D/A converting the pattern data of driving pluses stored in the ROM 502, a voltage amplifier, and a current amplifier. The print control unit 508 outputs driving signals constituted by one or more driving pulses to the head driver 509.

The head driver 509 drives the recording head 34 by applying driving pulses to a driving element (for example, a piezoelectric element) for generating energy to cause the recording head 34 to selectively jet liquid droplets. The applied driving pulses constitute driving signals received from the print control unit 508 based on image data corresponding to one line of the recording head 34 that is serially input. By selecting the driving pulses constituting the driving signals, dots of different sizes can be delivered, such as large drops, mid-sized dots, and small dots.

The control unit 500 includes an I/O unit 513 that acquires information from a group of sensors 515 including various sensors installed in the device, extracts information necessary for controlling the printer, and uses the information for controlling the print control unit 508, the motor driving unit 510, and the AC bias supply unit 511. The group of sensors 515 includes an optical sensor for detecting the position of a sheet, a thermistor for monitoring the temperature and humidity in the device, a sensor for monitoring the voltage of the conveying belt 51, and an interlock switch for detecting whether the cover is open. The I/O unit 513 can process various kinds of sensor information. The group of sensors 515 input to the I/O unit 513 include the full tank detection sensor 301 for detecting the displacement member (full tank detection filler) 205 of the head tank 35, and signals of the electrode pins 208*a*, 208*b*, and 208*c*.

The CPU 501 of the control unit 500 and the programs executed by the CPU 501 constitute the following means. One of the means is a means for detecting a full state of the head tank 35 by detecting the displacement member (full tank detection filler) 205 based on detection signals of the full tank detection sensor 301. Another means is a main tank end determining means for determining that the ink cartridge (main tank) 10 is in an end state when a liquid sending operation is performed with the liquid sending pump 241 but a full state cannot be detected at the head tank 35. Yet another means is a near end state detecting means for calculating the remaining amount of ink in the ink cartridge (main tank) 10 based on the ink volume of the ink cartridge (main tank) 10 set in advance and the consumed ink amount (soft count) jetted from the recording head 34 and detecting whether the remaining amount of ink in the ink cartridge (main tank) 10 has dropped below a predetermined amount. Yet another means is a means for detecting that the head tank 35 is in a full state based on the first set liquid sending amount when the remaining amount of ink in the ink cartridge (main tank) 10 exceeds a predetermined amount, and detecting that the head tank 35 is in a full state based on the second set liquid sending amount (which is greater than the first set liquid sending amount) when the remaining amount of ink in the ink cartridge (main tank) 10 is less than or equal to the predetermined amount (near end).

Figure 9:
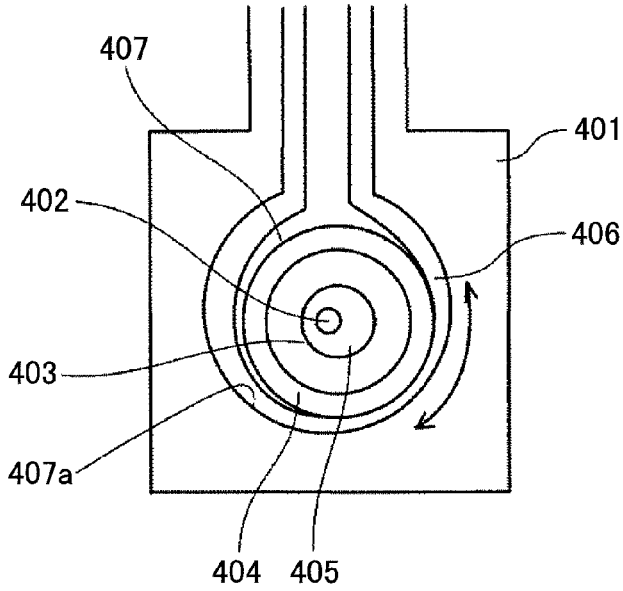
FIG. 9 is a schematic diagram for describing a tube pump constituting a liquid sending pump.

Next, a description is given of a tube pump constituting the liquid sending pump 241 with reference to schematic diagram of FIG. 9.

The tube pump includes a ring 403, a pressurizing roller (color) 404, a gear with an eccentric cam 405, and a gear cover (not shown), which are centering around a shaft 402 attached to a pump case 401. The gear with an eccentric cam 405 is engaged with a worm gear (not shown) attached to the pump driving motor 242 (see FIG. 8).

In the tube pump, the pump driving motor 242 is rotated in a normal direction or in a reverse direction, so that the gear with an eccentric cam 405 eccentrically rotates via the worm gear. Accordingly, the pressurizing roller 404 rotates while pressurizing a tube 406 against an inner wall 407*a* in a recessed space 407. As the pressurizing roller 404 pushes the tube 406 while rotating in either direction of the arrow in FIG. 9, ink is either supplied or suctioned. The tube 406 constitutes the supplying tube 36 described above.

Figure 10:
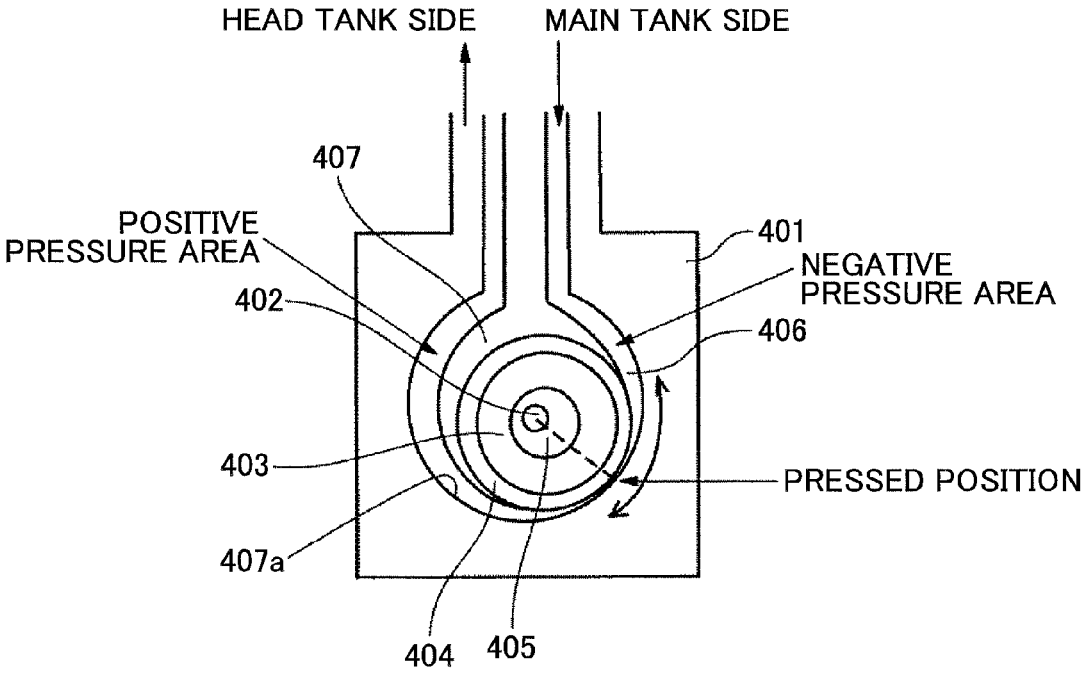
FIG. 10 is a schematic diagram for describing areas where negative pressure and positive pressure are generated on opposite sides of a position where the tube pump is pressed by a pressurizing roller when the remaining amount of ink is small.

With reference to FIG. 10, a description is given of the areas where negative pressure and positive pressure are generated on opposite sides of a position where the tube pump is pressed by the pressurizing roller 404 when the remaining amount of ink is small.

When the remaining amount of ink in the ink cartridge (main tank) 10 is small, the area of the tube pump before the position pressed by the pressurizing roller 404 becomes negative pressure, and the area of the tube pump beyond the position pressed by the pressurizing roller 404 becomes positive pressure (atmospheric pressure). Under negative pressure, the air passes through the flexible tube 406 due to the difference in partial pressure between the negative pressure area in the tube 406 and the external air, and therefore air enters the tube 406.

The amount of air entering the tube 406 depends on the volume of the tube 406. Thus, if the inner volume of the tube 406 is smaller than the required ink supply amount (supply volume), and assuming that the tube 406 is substantially filled with air and all of the air is supplied to the head tank 35, more ink supply will be necessary after supplying all of the air. Thus, an ink end state can be immediately detected.

Figure 11B:
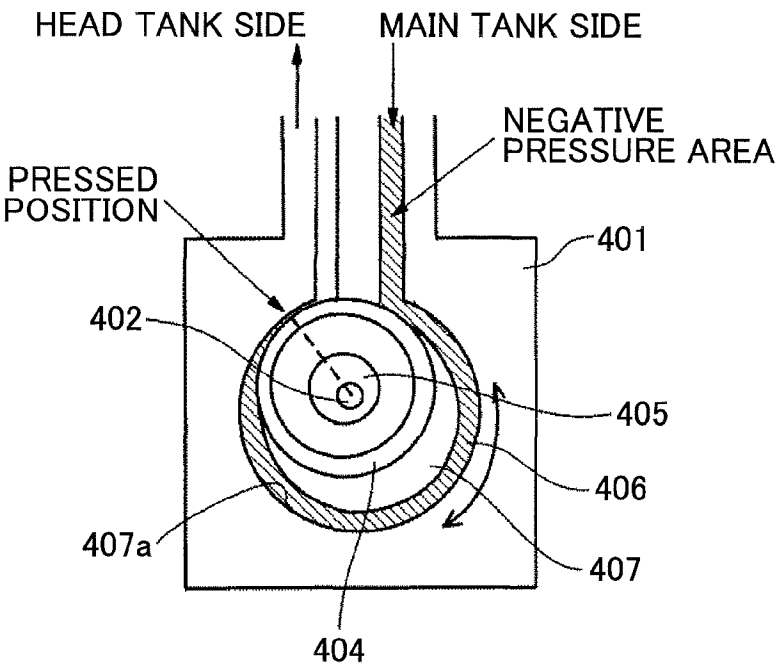
FIGS. 11A and 11B are schematic diagrams for describing a mechanism where the area that becomes negative pressure differs according to the position where the pressurizing roller presses the tube pump when the remaining amount of ink is small.
Figure 11A:
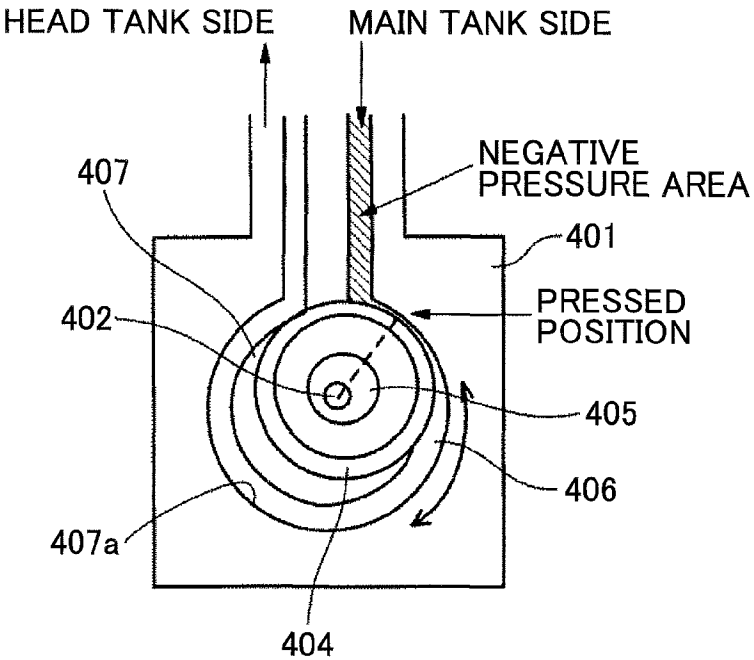

Next, with reference to the schematic diagrams of FIGS. 11A and 11B, a description is given of a mechanism where the area that becomes negative pressure differs according to the position where the pressurizing roller 404 presses the tube pump when the remaining amount of ink is small.

In the tube 406, negative pressure and positive pressure (atmospheric pressure) are generated on opposite sides of the position where the tube 406 is pressed by the pressurizing roller 404. Thus, the area of negative pressure changes depending on the position where the pressurizing roller 404 is stopping. When the pressurizing roller 404 is stopping at the position indicated in FIG. 11A, the area of negative pressure is small. When the pressurizing roller 404 is stopping at the position indicated in FIG. 11B, the area of negative pressure is large.

That is to say, the entire volume of the tube does not need to be reduced with respect to the required ink supply amount. By ensuring that the maximum volume of the negative pressure in the tube (determined by the position where the pressurizing roller 404 is stopping) is smaller than the ink supply amount, it is possible to detect a shortage in the ink supply amount even if air enters the tube.

Figure 12:
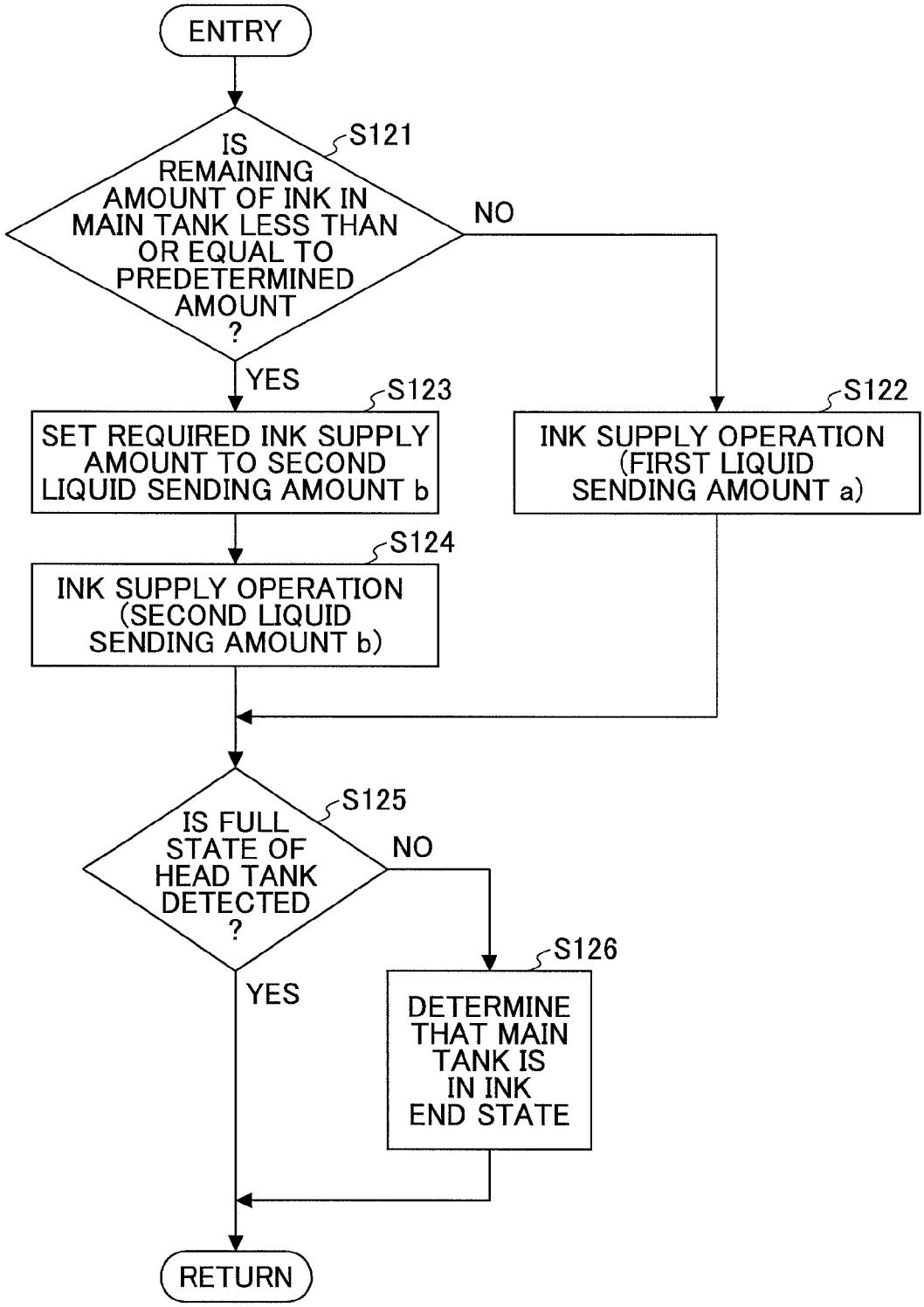
FIG. 12 is a flowchart for describing a control operation of sending ink from a main tank to the head tank according to a first embodiment of the present invention.

Next, with reference to the flow chart of FIG. 12, a description is given of a control operation of sending ink from the ink cartridge (main tank) 10 to the head tank 35 according to a first embodiment of the present invention.

As described above, when the amount of ink remaining in the ink cartridge (main tank) 10 is small, by making the required ink supply amount (liquid sending amount required for detecting a full state) greater than the inner volume of the negative pressure area of the tube 406 (supplying tube 36), it is possible to detect an ink end state. This relationship is required when the reaming amount of ink is approaching an ink end state (near end). Otherwise, the tube 406 does not become negative pressure, and therefore the required ink supply amount does not need to be increased.

Thus, as described above, when the consumed ink amount of the head tank 35 exceeds a threshold as ink droplets are jetted from the recording head 34, ink starts to be supplied from the ink cartridge (main tank) 10 to the head tank 35 (this process is entered).

In step S121, it is determined whether the remaining amount of ink in the ink cartridge (main tank) 10 is less than or equal to a predetermined amount (near end). If the remaining amount of in the ink cartridge (main tank) 10 is not less than or equal to a predetermined amount (NO in step S121), the ink supply operation is performed for supplying the normal required supply amount (first liquid sending amount a) (step S122). Specifically, when sending the ink by the first liquid sending amount a, the carriage 33 is moved to the position where the displacement member (full tank detection filler) 205 of the head tank 35 becomes displaced and a full state can be detected. Then, the liquid sending pump 241 is driven in the normal direction to send the first liquid sending amount a from the ink cartridge (main tank) 10 to the head tank 35.

Then, in step S125, it is determined whether the full state of the head tank 35 is detected. When the full state of the head tank 35 cannot be detected even if the first liquid sending amount a has been sent (NO in step S125), it is determined that the ink in the ink cartridge (main tank) 10 is in an end state (step S126), and a message prompting the user to replace the cartridge is displayed.

Meanwhile, if the remaining amount of in the ink cartridge (main tank) 10 is less than or equal to a predetermined amount (near end) (YES in step S121), the required ink supply amount is set to be the second liquid sending amount b which is greater than the first liquid sending amount a (step S123), and the ink supply operation is performed for supplying the second liquid sending amount b (step S124). Specifically, when sending the ink by the second liquid sending amount b, the carriage 33 is moved to the position where the displacement member (full tank detection filler) 205 of the head tank 35 becomes displaced and a full state can be detected. Then, the liquid sending pump 241 is driven in the normal direction to send the second liquid sending amount b from the ink cartridge (main tank) 10 to the head tank 35.

Then, in step S125, it is determined whether the full state of the head tank 35 is detected. When the full state of the head tank 35 cannot be detected even if the second liquid sending amount b has been sent (NO in step S125), it is determined that the ink in the ink cartridge (main tank) 10 is in an end state (step S126), and a message prompting the user to replace the cartridge is displayed.

That is to say, as described above, assuming that the supplying tube 36 is substantially filled with air, the ink supply amount required for detecting a full state is increased. Therefore, even after all of the air is supplied, ink would still need to be supplied. Nevertheless, if there is no more ink remaining in the ink cartridge (main tank) 10, there would not be enough ink for supplying the second liquid sending amount (ink supply amount required for detecting a full state). Therefore, a full state of the head tank 35 cannot be detected, and the ink end state of the ink cartridge (main tank) 10 is immediately detected.

As described above, in the full state detection unit, the liquid sending amount of ink sent from the main tank required for detecting a full state of the head tank can be switched between a first liquid sending amount and a second liquid sending amount that is greater than the first liquid sending amount. When the remaining amount of ink in the main tank exceeds a predetermined amount, the operation of detecting the full state of the head tank is performed by sending the first liquid sending amount. When the remaining amount of ink in the main tank is less than a predetermined amount, the operation of detecting the full state of the head tank is performed by sending the second liquid sending amount. Accordingly, if air enters the tube and all of the air is supplied, an amount of ink corresponding to the difference between the second liquid sending amount and the first liquid sending amount would still need to be supplied. Nevertheless, if there is no more ink remaining in the main tank, a full state cannot be detected at the head tank, and the ink end state of the main tank can be immediately detected. Therefore, the ink end state can be immediately detected when the main tank is out of ink.

Figure 13:
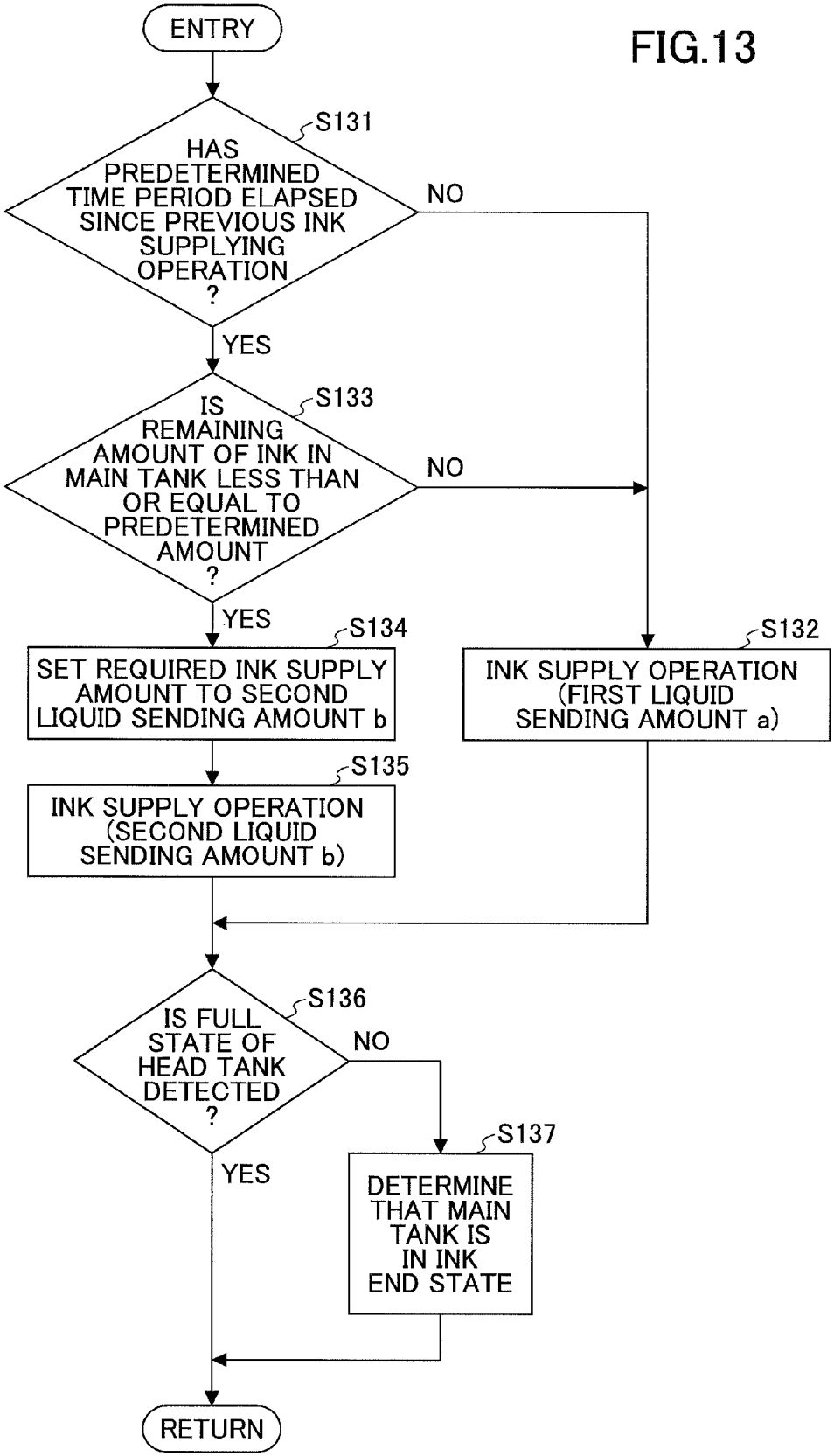
FIG. 13 is a flowchart for describing a control operation of sending ink from the main tank to the head tank according to a second embodiment of the present invention.

Next, with reference to the flow chart of FIG. 13, a description is given of a control operation of sending ink from the ink cartridge (main tank) 10 to the head tank 35 according to a second embodiment of the present invention.

When the ink cartridge (main tank) 10 approaches a near end state, a predetermined time period needs to elapse in order for air to pass through the supplying tube 36 due to the difference in partial pressure between the negative pressure area in the supplying tube 36 and the external air.

Thus, in the present embodiment, when the ink supplying operation starts, it is determined whether a predetermined time period set in advance has elapsed since the previous ink supplying operation (step S131). When the predetermined time period has not passed (NO in step S131), the ink supplying operation is performed for supplying the normal required supply amount (first liquid sending amount a) (step S132). When the predetermined time period has passed (YES in step S131), similar processes as the first embodiment are performed (steps S133 through S137).

Thus, there is no need to needlessly adjust (change) the ink supply amount required for detecting a full state. Therefore, restrictions in controlling the liquid pumping operation can be minimized.

Next, with reference to the flow chart of FIG. 14, a description is given of a control operation of sending ink from the ink cartridge (main tank) 10 to the head tank 35 according to a third embodiment of the present invention.

In the present embodiment, when the ink supply amount required for detecting a full state of the head tank 35 is increased, and the operation of supplying ink from the ink cartridge (main tank) 10 to the head tank 35 is performed with the increased ink amount (second liquid sending amount b), and a full state of the head tank 35 is detected, the following steps are performed. That is, the liquid sending pump 241 is driven in the reverse direction to return the increased amount of ink (difference between b and a (b−a)) from the head tank 35 to the ink cartridge (main tank) 10 (step S149).

Accordingly, in the ink supply operation, the head tank 35 can be surely filled with the amount of ink required in the head tank 35 (the usual first liquid sending amount a).

The above-described process of the ink supplying operation according to an embodiment the present invention is executed by a computer according to a program stored in the ROM 502. This program can be installed in the image forming apparatus by being downloaded in the information processing apparatus (host 600). Furthermore, the above process may be executed at a printer driver of the information processing apparatus (host 600). Furthermore, an image forming system may be constituted by combining the image forming apparatus and the information processing apparatus according to an embodiment of the present invention, or by combining the image forming apparatus and the information processing apparatus including the program for executing the process according to an embodiment of the present invention.

According to one embodiment of the present invention, an image forming apparatus is provided, with which the following effects can be achieved. In a full state detection unit, the liquid sending amount of ink sent from the main tank required for detecting a full state of the head tank can be switched between a first liquid sending amount and a second liquid sending amount that is greater than the first liquid sending amount. When the remaining amount of ink in the main tank exceeds a predetermined amount, the operation of detecting the full state of the head tank is performed by sending the first liquid sending amount. When the remaining amount of ink in the main tank is less than a predetermined amount, the operation of detecting the full state of the head tank is performed by sending the second liquid sending amount. Accordingly, if air enters the tube and all of the air is supplied, an amount of ink corresponding to the difference between the second liquid sending amount and the first liquid sending amount would still need to be supplied. Nevertheless, if there is no more ink remaining in the main tank, a full state cannot be detected at the head tank, and the ink end state of the main tank can be immediately detected. Therefore, the ink end state can be immediately detected when the main tank is out of ink.

The present invention is not limited to the specific embodiments described herein, and variations and modifications may be made without departing from the scope of the present invention.

The present application is based on Japanese Priority Patent Application No. 2010-269777, filed on Dec. 2, 2010, the entire contents of which are hereby incorporated herein by reference.

What is claimed is:

1. An image forming apparatus comprising:

a recording head configured to jet liquid droplets;

a head tank configured to accommodate liquid to be supplied to the recording head;

a main tank configured to accommodate liquid to be supplied to the head tank;

a liquid sending pump configured to send the liquid from the main tank to the head tank;

a full tank detection unit configured to detect whether the head tank is in a full state when sending liquid from the main tank to the head tank;

an empty determination unit configured to determine an empty state of the main tank, when the full state of the head tank is not detected by the full tank detection unit even if a predetermined liquid sending amount is sent from the main tank to the head tank; and a near empty detection unit configured to detect whether a remaining liquid amount in the main tank is less than or equal to a predetermined remaining amount, wherein the full tank detection unit switches the predetermined liquid sending amount to be sent from the main tank to the head tank, which is required for detecting whether the head tank is in the full state, between a first liquid sending amount and a second liquid sending amount that is greater than the first liquid sending amount, wherein the full tank detection unit detects whether the head tank is in the full state based on a liquid sending operation of sending the first liquid sending amount, when the remaining liquid amount in the main tank is greater than the predetermined remaining amount, and the full tank detection unit detects whether the head tank is in the full state based on a liquid sending operation of sending the second liquid sending amount, when the remaining liquid amount in the main tank is less than or equal to the predetermined remaining amount.

2. The image forming apparatus according to claim 1, wherein the full tank detection unit detects whether the head tank is in the full state based on the liquid sending operation of sending the second liquid sending amount, when a liquid sending interval between liquid sending operations of sending the liquid from the main tank to the head tank is greater than or equal to a predetermined time period.

3. The image forming apparatus according to claim 1, wherein the liquid sending pump is a reversible pump through which the liquid can be sent in a reverse direction from the head tank to the main tank, wherein when the full tank detection unit detects that the head tank is in the full state based on the liquid sending operation of sending the second liquid sending amount, a difference liquid amount is sent in the reverse direction from the head tank to the main tank, the difference liquid amount corresponding to a difference between the first liquid sending amount and the second liquid sending amount.

* * * * *